US005386278A

United States Patent [19]

Maeyama et al.

[11] Patent Number: 5,386,278

[45] Date of Patent: Jan. 31, 1995

[54] CLEANING FIBER, CLEANING BRUSH AND IMAGE FORMING APPARATUS USING THE SAME

[75] Inventors: Ryuichiro Maeyama, Yokohama; Takahiro Kubo, Tokyo, both of Japan

[73] Assignee: Canon Kabushiki Kaisha, Tokyo, Japan

[21] Appl. No.: 198,778

[22] Filed: Feb. 18, 1994

[30] Foreign Application Priority Data

Feb. 22, 1993 [JP] Japan ..... 5-032216

[51] Int. Cl.[6] ..... G03G 21/00

[52] U.S. Cl. ..... 355/271; 355/301; 15/207.2; 428/87

[58] Field of Search ..... 355/200, 210, 282, 283, 355/296, 301, 271; 15/207.2; 428/87

[56] References Cited

U.S. PATENT DOCUMENTS 4,319,831 3/1982 Matsui et al. .

*Primary Examiner*—R. L. Moses

*Attorney, Agent, or Firm*—Fitzpatrick, Cella, Harper & Scinto

[57] ABSTRACT

The present invention relates to cleaning fiber provided for a cleaning unit of an image forming apparatus such as an electrostatic copying machine or an electrostatic printer using an electrostatic process, the cleaning fiber being capable of quickly removing transferred oil which causes oil fog to be generated. The cleaning fiber according to the present invention contains inorganic porous particles dispersed therein.

15 Claims, 4 Drawing Sheets

(TWO - SIDE COPYING MODE)

(POST - ROTATION OF TRANSFER DRUM)

(NEXT COPYING OPERATION)

CLEANING FIBER, CLEANING BRUSH AND IMAGE FORMING APPARATUS USING THE SAME

BACKGROUND OF THE INVENTION

1. Field of the Invention

The present invention relates to an image forming apparatus such as an electrostatic copying machine or an electrostatic printer that uses an electrostatic process, and more particularly to cleaning fiber used in a cleaning apparatuses of the image forming apparatus.

2. Description of the Prior Art

An image forming apparatus such as an electrostatic copying machine or an electrostatic printer of a type using an electrostatic process usually comprises a photosensitive drum having photosensitive layer on the outer surface thereof, the image forming apparatus further comprising, around the photosensitive drum thereof, a charger for uniformly charging the photosensitive member, a developing machine for supplying a charging toner to the photosensitive layer having an electrostatic latent image formed by partial exposure to make the latent image to be a visible image, a transferring unit for transferring the toner on the photosensitive layer onto a transferring member such as paper, an electricity remover unit for removing electricity from the photosensitive layer and the toner after the toner has been transferred, and a cleaning unit for recovering non-transferred toner on the photosensitive layer.

The cleaning unit for the image forming apparatus has been arranged to remove a residual toner by rotating, for example, a fur brush or a nylon brush. Another cleaning unit has been arranged in such a manner that an electric conductive fiber is used to form a brush which electrostatically removes the residual toner.

However, when the fixed toner image is used to form a so-called two-side image by again supplying paper, the conventional structures have suffered from a problem in that a separating agent, such as silicon oil, allowed to adhere to the paper after the image has been fixed is stuck to the paper supply rollers, paper conveyance portion, transferring drum and the photosensitive drum and the like, causing the image forming process to be interrupted. If the silicon oil adheres to the photosensitive drum, a problem called "oil fog" arises.

The mechanism of the generation of the foregoing phenomenon will now be described with reference to FIG. 1.

(1) First, a portion of silicon oil present on the fixed toner image is transferred to the surface of the transferring drum.

(2) Then, the transferred silicon oil present on the transferring drum is shifted to the photosensitive drum through a nip after the rotation has been performed.

(3) The transferred silicon oil brought to the photosensitive drum sticks to the toner present in the vicinity of the photosensitive drum and transfers the toner at the time of the next transferring process, causing the phenomenon called "fog" to take place.

In order to prevent the foregoing phenomenon, the transferred silicon oil must quickly be removed. However, the conventional fur brush cannot remove the silicon oil because it has no function of absorbing the silicon oil.

SUMMARY OF THE INVENTION

An object of the present invention is to provide cleaning fiber capable of quickly removing a separating agent, such as silicon oil.

Another object of the present invention is to provide an image forming apparatus comprising cleaning fiber of the foregoing type.

Cleaning fiber according to the present invention, which contains inorganic porous particles, is capable of absorbing a separating agent. The cleaning fiber according to the present invention is able to quickly remove a separating agent allowed to adhere to a member for holding a transferring member, such as a transferring drum or a transferring belt, or a photosensitive member, such as a photosensitive drum or a photosensitive sheet, by causing it to be absorbed by inorganic porous particles. That is, since the surfaces of the inorganic porous particles are in the form of fine pores which quickly absorb the separating agent due to capillarity, the separating agent can quickly be removed as compared with sponge for example.

Other and further objects, features and advantages of the invention will be appear more fully from the following description.

DESCRIPTION OF THE PREFERRED EMBODIMENT

Preferred inorganic porous particles dispersed and contained in cleaning fiber according to the present invention are exemplified by irregular porous silica particles, porous compound particles mainly composed of alumina and alumina hydrate and a colloidal metal compound, such as colloidal titania or colloidal zirconia.

If the porous compound particles mainly composed of alumina and alumina hydrate have apertures having average aperture size ranging from 1 to 20 nm, maximum absorbing ability is obtained in a case where the particles are added by 7 wt % regardless of the type of the fiber. Therefore, it is preferable to use porous compound particles of a type having apertures, the average aperture size ranges as described above.

It is preferable that the diameter of the fiber ranges from 3 to 20 deniers. If it is 3 deniers or larger, the fiber can easily be handled. If it is smaller than 20 deniers, mechanical influence upon a member to be cleaned and noise can be prevented.

Figure 1:
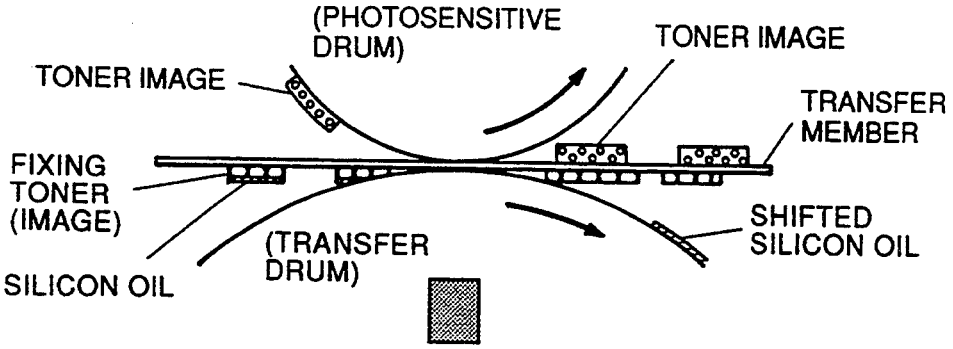
FIG. 1(1), FIG. 1(2) and FIG. 1(3) are views which illustrates the mechanism of occurrence of image contamination due to transference of separating oil to a photosensitive drum.
Figure 1:
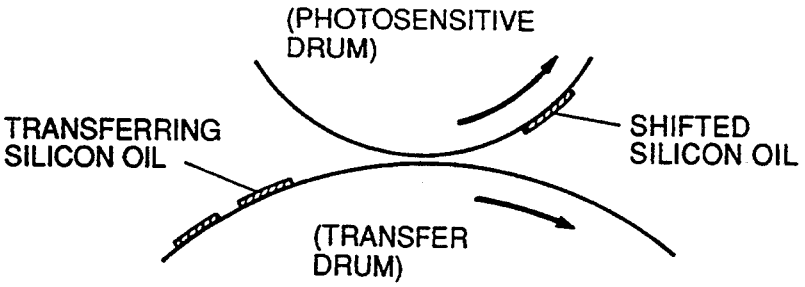
Figure 1:
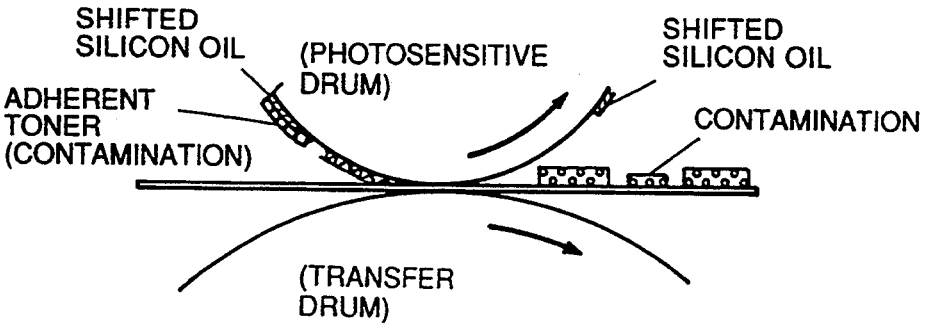

An example of an image forming apparatus using the cleaning fiber according to the present invention is shown in FIG. 1.

FIG. 1 illustrates an electrophotographic color copying machine for forming a full color image. Referring to FIG. 1, the electrophotographic color copying machine comprises an electrophotographic photosensitive member in the form of a drum serving as an image carrier, that is a photosensitive drum 1 which is held rotatively in a direction designated by an arrow. In a space around the photosensitive drum 1, there are disposed a corona charger 2, an exposing optical system 3, a developing machine 4, a transferring drum 5 and a cleaner 6.

The optical system 3 comprises an original document scanning portion 3*a* and a color decomposing filter 3*b* so that the photosensitive drum 1 uniformly charged by the charger 2 is irradiated with an optical image for each color-decomposed image. As a result, a latent image is formed. The developing machine 4 in the form of a rotative developing apparatus has four developing units around a central axis 4*b*, that is, a yellow developing unit 4Y, a magenta developing unit 4M, a cyan developing unit 4C and a black developing unit 4B. A predetermined developing unit is rotated to a position at which it faces the photosensitive drum 1 to develop the latent image on the photosensitive drum 1. As a result, it forms a toner image on the photosensitive drum 1.

The toner image formed on the photosensitive drum 1 is, by way of a conveyance system and the transferring unit 5, transferred onto a transferring member supplied from a transfer member cassette 7 to a position at which is faces the photosensitive drum 1. The transferring unit 5 comprises a cylinder 5*a*, a transferring charger 5*b*, a transferring member gripper 5 for gripping and conveying the transferring member, an internal charger 5*d* and an outer charger 5*e*. Further, an opening area formed in the cylinder 5*a* has a transferring member holding sheet 5*f* made of a dielectric material in the form of a cylinder and applied thereto.

When the transferring drum 5 which is a drum transferring unit is rotated, the toner image on the photosensitive drum 1 is, by the transferring member charger 5*b*, transferred onto the transferring member held by the transferring member holding sheet 5*f*. Simultaneously, the transferring member is adsorbed into the transferring member holding sheet 5*f*. The photosensitive drum 1 performs the next image forming process immediately after the left toner has been removed by the cleaner 6.

Color images of desired number of colors are transferred onto the transferring member adsorbed and conveyed by the transferring member holding sheet 5*f* so that a full color image is formed.

After the four color toner images have been transferred as described above, the transferring member is separated from the transferring drum 5. Then, the transferring member is discharged onto a tray 10 by way of a heat roller fixer 9 having a fixing roller 9*a*. The fixing roller 9*a* has, on the surface thereof, a separating agent applied to prevent adhesion of the toner to the fixing roller 9*a* when the toner images are heated under pressure to be fixed. The separating agent is exemplified by oil, such as silicon oil, ester oil, liquid polyether, spindle oil, machine oil or cylinder oil. The separating agent may be supplied while being contained in the toner particles in place of the supply method in which it is supplied to the fixing roller from an oil tank.

The electrophotographic color copying machine comprises the transferring drum 5 having, in the opening portion formed in the surface thereof, the member for holding the transferring member for holding the transferring member, that is the transferring member holding sheet 5*f* made of the dielectric material. In the vicinity of the transferring drum 5, a unit group composed of, for example, the photosensitive drum 1, the developing machine 4 and the cleaner 6 and the like which hold or accommodate the developer (the toner), is disposed. Therefore, the transferring member holding sheet 5*f* on the transferring drum 5 is sometimes contaminated because an undesirable toner flown from the unit group sticks to it. When a transferring member, to which the toner image has been transferred but on which it has not been fixed, is separated from the transferring drum 5, the toner on the transferring member sticks to the transferring member holding sheet 5*f* if the transferring member is jammed (the transferring member is jammed in the machine). As a result, the transferring member holding sheet 5*f* is contaminated excessively.

In order to remove the toner allowed to stick to the surface of the transferring member holding sheet 5*f*, the transferring drum 5 has a transferring member holding sheet cleaner, that is a cleaner 11. The transferring member holding sheet 5*f* is usually cleaned when the pre-rotation of the transferring drum 5 is performed before the transferring process is performed. However, the transferring member holding sheet 5*f* is cleaned at any time after the transferring member has been jammed as described above.

The transferring member holding sheet cleaner 11 comprises a fur brush cleaner 11*a* disposed on the outside of the transferring member holding sheet 5*f* arranged on the surface opening portion of the cylinder 5*a* which is a cylindrical means for supporting the transferring member holding sheet, the transferring member holding sheet cleaner 11 further comprising a backup brush 11 disposed on the inside of the cylinder 5*a*.

When the fixed image is used to form a so-called two side image by again supplying paper as shown in FIG. 1, the separating agent, such as the silicon oil, allowed to adhere to the paper after the image has been-fixed is caused to adhere to the paper supply roller, the paper conveyance portion, the transferring drum and the photosensitive drum. As a result, the image contamination takes place. Therefore, the present invention employs fiber to form the cleaner 11, the fiber containing dispersed inorganic porous particles to effectively prevent the image contamination. The cleaner formed by the fiber containing the dispersed inorganic porous particles is disposed to be in contact with the member for holding the transferring member, such as the transferring drum and a transferring belt and/or the photosensitive member, such as the photosensitive drum and the photosensitive sheet.

Example 1

Figure 2:
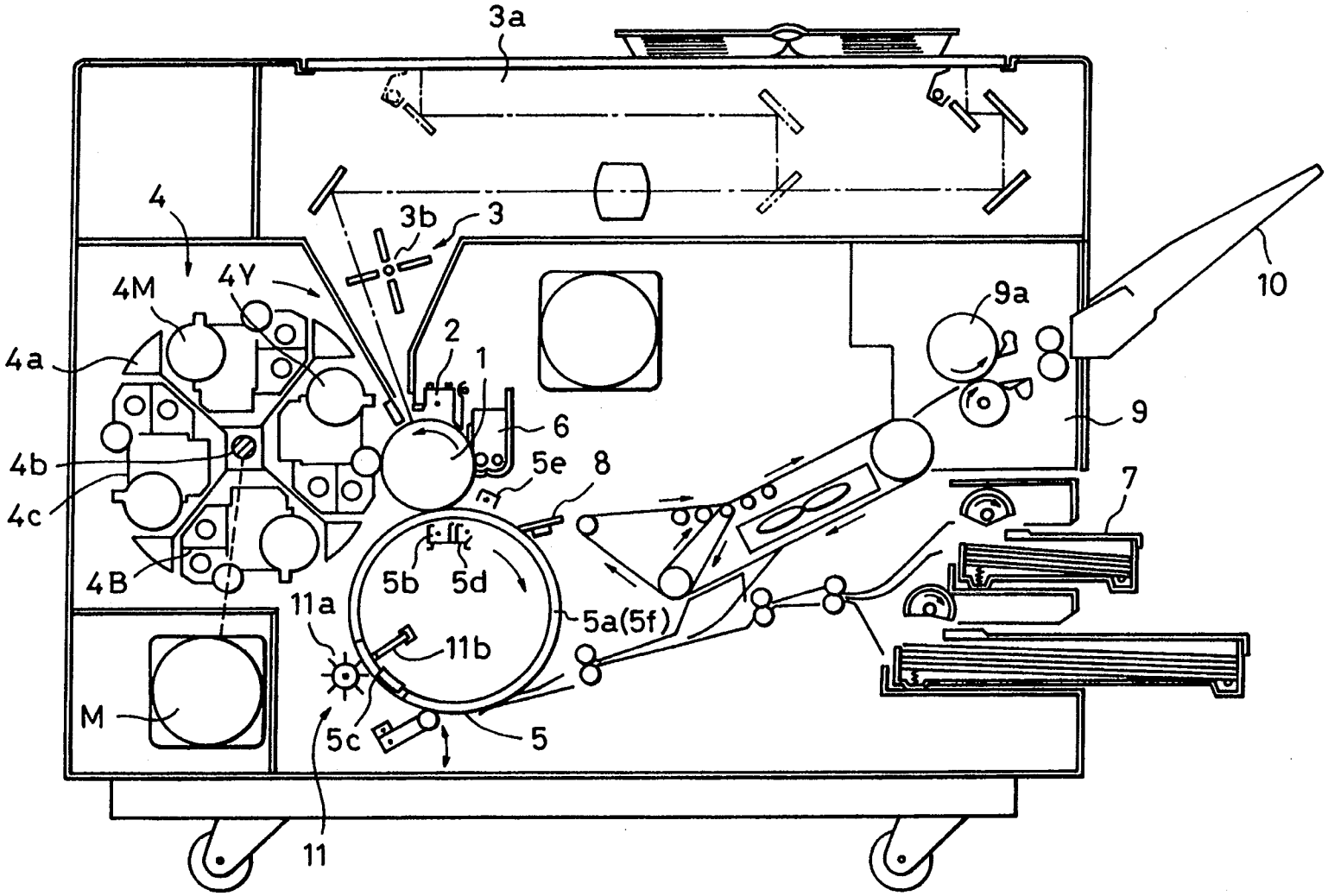
FIG. 2 is a schematic cross sectional view which illustrates an image forming apparatus according to the present invention.
Figure 3:
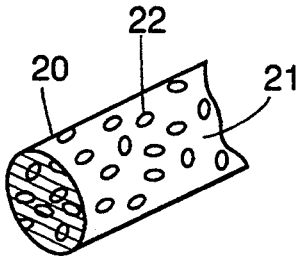
FIGS. 3 to 5 are views which illustrate aspects of cleaning fiber according to the present invention.

FIG. 3 is an enlarged perspective view which illustrates fiber for the brush according to an embodiment of the present invention. Fiber 20 for the brush for use in the fur brush cleaner 11*a* shown in FIG. 2 is manufactured by uniformly dispersing, in fiber 21 made of rayon or nylon, inorganic porous particles, that is irregular porous silica particles or porous compound particles 22 mainly composed of alumina and alumina hydrate and by giving oil absorbing characteristics of the silicon oil to the overall portion of the fiber.

The fiber 20 for the brush can easily be manufactured by blending, in a molten raw material of synthetic fiber, porous silica particles, which are inorganic porous particles or porous compound particles 22 mainly composed of alumina and alumina hydrate and by drawing it through a nozzle.

The porous silica particles for use in the present invention can be prepared by, for example, the following method. 16% $H_2SO_4$ water solution is injected into a stainless steel container, and about 7% solution of $SiO_2$ diluted by water glass is dripped in such a manner that the $H_2SO_4$ water solution is stirred sufficiently to make the pH of the mixed solution to be 3.0. The operation of stirring is continued for about one hour after the material has been allowed to gel, and then an ammonia solution is used to neutralize it to have a pH of 7.5.

The obtained solution is granulated by a spray dry method so that dry particles are obtained (the particle size is distributed to 10 to 150 μm). Then, ammonia carbonate solution is used to remove $Na^+$and $SO_4^{2-}$, and then the material was baked at 350° C. for two hours and crushed and classified. As a result, irregular porous particles (in the form realized by arbitrarily crushing the material) having a particle size of about 10 μm can be obtained.

The porous compound mainly composed of alumina and alumina hydrate for use in the present invention can be prepared by, for example, the following method. Alumina sol, for example, Nissan Chemical "100" or AS-3 manufactured by Shokubai Kasei available from the market and in the form of a water solution is injected into a stainless steel container to be baked at 350° C. for two hours, and crushed and classified so that porous compound particles are obtained.

The fur brush cleaner 11*a* was evaluated by the following method. Canon CLC-500 was used and the quantity of application of silicon oil KF-96, the viscosity of which was 300 cs and which was manufactured by Shinetsu Kagaku was adjusted to 0.08 g per A4-size sheet. The quantity of application was evaluated depending upon the quantity of the silicon oil per sheet after fifty white sheets had been allowed to pass.

Then, a mono-color or plural-color image was formed in such a manner that the quantity of toner transfer was made to be 1.5 g/A4-size sheet. Then, the sheets were inverted to continuously form arbitrary images on five sheets and the process was completed.

Then, for example, an A3-size white sheet was allowed to pass to evaluate whether or not the first color toner was mainly transferred to the white paper if the toner density was lowered to 0 in an excessive case. The toner particles present on the sleeve of the developing unit are shifted because the transferred oil is present on the photosensitive drum though no bias was applied. The shifted toner is transferred because it has an electric charge. Therefore, a discrimination can be made whether or not the silicon oil was able to be removed because the presence of the shifted oil causes fog to be generated on the white paper.

The reason why the first color is mainly transferred is that the first color toner allowed to adhere to the oil serve as a spacer to cause the second or ensuing toners to be difficult to be allowed to adhere. If the quantity of fog indicated a Macbeth density meter is 0.10, the fog can be visually recognized. Therefore, the values of the Macbeth density meter were used to make evaluations. It was found that the manufactured fur brush cleaner 11*a* was able to remove the silicon oil.

Examples 2 and 3

Figure 4:
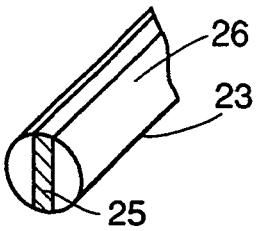
Figure 5:
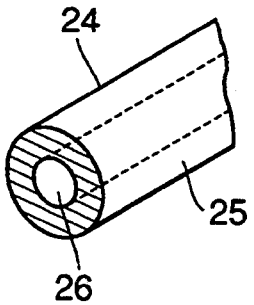

FIGS. 4 and 5 are enlarged perspective views which illustrate fiber for a brush according to second and third embodiments of the present invention. Fiber 23 for a brush shown in FIG. 4 (the second embodiment) has improved strength by covering the two sides of fiber 25 in which irregular porous particles or porous compound particles mainly composed of alumina or alumina hydrate are uniformly dispersed in flat synthetic fiber, such as rayon or nylon with reinforcing fiber 26 such as nylon containing neither irregular porous particles nor porous compound particles mainly composed of alumina or alumina hydrate.

Fiber 24 for a brush shown in FIG. 5 is enabled to have improved strength by making the reinforcing fiber 26 such as nylon containing neither irregular porous particles nor porous compound particles mainly composed of alumina or alumina hydrate to be a central core having a circular cross sectional area and by covering the reinforcing fiber 26 with fiber 25 for a brush containing irregular silica porous particles or porous compound particles mainly composed of alumina or alumina hydrate. The fiber for a brush according to the second and third embodiment was able to remove the silicon oil.

It is preferable that the fiber (20, 23 or 24) for a brush has a diameter of 3 to 20 deniers. If it is thinner than 3 deniers per filament, handling becomes inconvenient. If it is thicker than 20 deniers, a member to be cleaned is influenced adversely.

Since the thickness of the fiber for a brush is preferable to range from 3 to 20 deniers, 300D/100F thread may be used, the diameter of which is 300 deniers by combining 100 single filaments each having a diameter of 3 deniers. When a brush roller is formed by using the foregoing fiber (20, 23 or 24), it is preferable to make the fiber density to be 10,000 to 200,000 filaments per square inch.

Although the embodiments of the present invention is arranged in such a manner that the fur brush cleaner 11*a* is provided for the transfer drum, it may be disposed downstream in a direction in which the drum of the cleaner of the photosensitive drum is rota. As an alternative to this, the fur brush cleaner 11*a* may be disposed at a position behind the fixing portion to remove the silicon oil on the fixed image or the transferring member.

Figure 6:
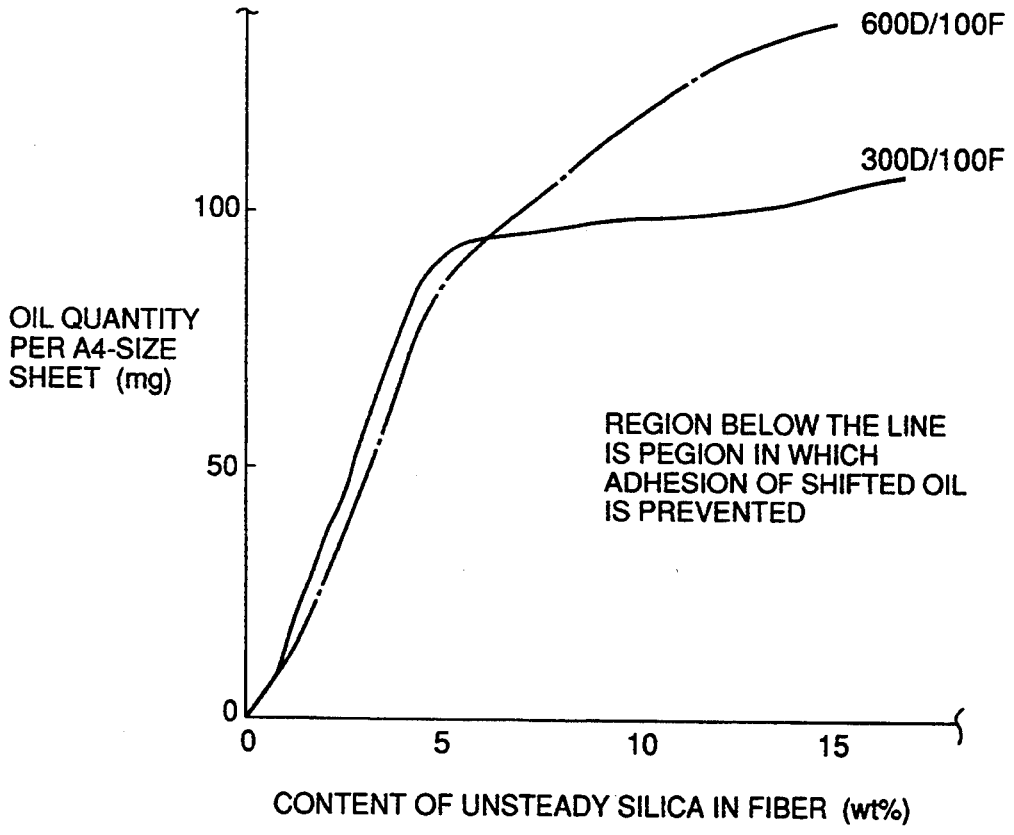
FIG. 6 is a view which illustrates a region in which transference of the separating oil is prevented.

Since the quantity of the applied silicon oil was 80 mg per A4-size paper in each of the foregoing embodiments, the content of the irregular silica (or the porous compound particle mainly composed of alumina or alumina hydrate not shown) contained in the fiber was, for example, 5 wt % as shown in FIG. 6. Since the silicon oil can be absorbed due to the presence of the irregular porous silica particles (or the porous compound particle mainly composed of alumina or alumina hydrate), the foregoing object can be achieved regardless of the type of the fiber as shown in FIG. 6.

Example 4

Silica gel (trade name: CATALOID SI-350 manufactured by Shokubai Kasei) containing a solid component by a concentration of 30 wt % was used in place of the alumina sol according to Example 1 so that a cleaning brush was obtained. The thus-obtained brush was used similarly to Example 1, resulting in that the silicon oil was able to be removed.

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. A cleaning fiber comprising inorganic porous particles dispersed in the fiber thereof.

2. A cleaning fiber according to claim 1, wherein said fiber containing said inorganic porous particles dispersed therein is, on the two sides thereof, covered with a reinforcing fiber containing no inorganic porous particles.

3. A cleaning fiber according to claim 1, wherein said reinforcing fiber containing no inorganic porous particles is fully covered with a fiber in which inorganic porous particles are dispersed.

4. A cleaning fiber according to claim 1, wherein said inorganic porous particles are irregular silica porous particles.

5. A cleaning fiber according to claim 1, wherein said inorganic porous particles are porous particles mainly composed of alumina and alumina hydrate.

6. A cleaning fiber according to claim 5, wherein said porous particles mainly composed of alumina and alumina hydrate have apertures, the average size of which ranges from 1 to 20 nm.

7. A cleaning fiber according to any one of claims 1 to 6, wherein the thickness of said fiber ranges from 3 to 20 deniers.

8. A cleaning brush for use in an image forming apparatus, said cleaning brush comprising:

a fiber of said brush having inorganic porous particles dispersed therein.

9. A cleaning brush according to claim 8, wherein said inorganic porous particles are irregular silica porous particles.

10. A cleaning brush according to claim 8, wherein said inorganic porous particles are porous particles mainly composed of alumina and alumina hydrate.

11. An image forming apparatus having a fixing unit using fixing means having a separating agent to fix a toner image transferred onto a transferring member, said image forming apparatus comprising:

a cleaning member including a fiber containing inorganic porous particles for absorbing said separating agent, said inorganic porous particles being dispersed therein.

12. An image forming apparatus according to claim 11, wherein said inorganic porous particles are irregular silica porous particles.

13. An image forming apparatus according to claim 11, wherein said inorganic porous particles are porous particles mainly composed of alumina and alumina hydrate.

14. An image forming apparatus according to claim 11, wherein said cleaning member is a cleaning brush.

15. An image forming apparatus according to claim 11, wherein toner image forming means are disposed on the two sides of said transferring member.

* * * * *

UNITED STATES PATENT AND TRADEMARK OFFICE

CERTIFICATE OF CORRECTION

PATENT NO. : 5,386,278

DATED : January 31, 1995

INVENTOR(S) : RYUICHIRO MAEYAMA, ET AL.

It is certified that error appears in the above-identified patent and that said Letters Patent is hereby corrected as shown below:

IN THE DRAWINGS

Sheet 4 of 4, "PEGION" should read --REGION--.

COLUMN 1

Line 12, "apparatuses" should read --apparatus--.

COLUMN 2

Line 29, "illustrates" should read --illustrate--.
Line 32, "cross sectional" should read --cross-sectional--.
Line 65, "FIG. 1." should read --FIG. 2.--.
Line 66, "FIG. 1" should read --FIG. 2--.
Line 68, "FIG. 1," should read --FIG. 2,--.

COLUMN 3

Line 26, "is" should read --it--.
Line 42, "left" should read --residual--.
Line 64, "member for holding the" should read --member,--.
Line 65, "transferring member" should be deleted.

COLUMN 4

Line 32, "brush 11" should read --brush 11a--.
Line 37, "been-fixed" should read --been fixed--.

COLUMN 5

Line 56, "serve" should read --serves--.
Line 58, "indicated" should read --indicated by--.

UNITED STATES PATENT AND TRADEMARK OFFICE

CERTIFICATE OF CORRECTION

PATENT NO. : 5,386,278

DATED : January 31, 1995

INVENTOR(S) : RYUICHIRO MAEYAMA, ET AL.

It is certified that error appears in the above-identified patent and that said Letters Patent is hereby corrected as shown below:

COLUMN 6

Line 14, "cross sectional" should read --cross-sectional--.
Line 19, "embodiment" should read --embodiments--.
Line 34, "is" should read --are--.
Line 39, "rota." should read --rotated.--.
Line 51, "particle" should read --particles--.

Signed and Sealed this

Thirtieth Day of May, 1995

Bruce Lehman

*Attest:*

BRUCE LEHMAN

*Attesting Officer*

*Commissioner of Patents and Trademarks*